United States Patent [19]

Voigts et al.

[11] Patent Number: 4,862,973

[45] Date of Patent: Sep. 5, 1989

[54] DRILLING DERRICK DEVICE

[75] Inventors: Eckhard Voigts, Bad Bentheim; Hans H. Achilles, Peine-Stederdorf; Adolf Häussler, Buckenhof; Eberhard Peschel, Celle, all of Fed. Rep. of Germany

[73] Assignees: Deutag Deutsche Tiefbohr-AG, Bad Bentheim; Wintershall AG, Kassel; Siemens AG, Erlangen; Preussag AG Erdöl und Erdgas, Hanover, all of Fed. Rep. of Germany

[21] Appl. No.: 90,731

[22] Filed: Aug. 28, 1987

[30] Foreign Application Priority Data

Sep. 3, 1986 [DE] Fed. Rep. of Germany ..... 3629946

[51] Int. Cl.[4] ..... E21B 19/14

[52] U.S. Cl. ..... 175/52; 175/85; 414/22.63; 414/22.71

[58] Field of Search ..... 175/85, 52; 414/22, 414/22.63, 22.65, 22.68, 22.71

[56] References Cited

U.S. PATENT DOCUMENTS

| | | | |
|---|---|---|---|
| 2,628,725 | 2/1953 | Stone | 414/22 |
| 2,773,605 | 12/1956 | De Jarnett | 414/22 |
| 3,061,011 | 10/1962 | Pager | 414/22.65 X |
| 3,701,435 | 10/1972 | Woolslayer et al. | 175/85 X |
| 3,883,009 | 5/1975 | Swoboda, Jr. et al. | 414/22.65 X |
| 4,274,778 | 6/1981 | Putnam et al. | 175/85 X |
| 4,445,579 | 5/1984 | Bello | 175/85 X |

FOREIGN PATENT DOCUMENTS

| | | | |
|---|---|---|---|
| 968463 | 2/1958 | Fed. Rep. of Germany | 414/22 |
| 8401599 | 4/1984 | PCT Int'l Appl. | 175/85 |
| 901462 | 1/1982 | U.S.S.R. | 175/52 |
| 2083106 | 3/1982 | United Kingdom | 175/52 |
| 2175629 | 12/1986 | United Kingdom | 175/85 |

*Primary Examiner*—Hoang C. Dang
*Attorney, Agent, or Firm*—Jordan and Hamburg

[57] ABSTRACT

A drilling derrick device for handling drill-pipe stands has at least one movable racking platform with pipe-stand receiving compartments, supported above the working deck of the derrick, at least one racking carriage associated with the racking platform and movable on the working deck and a pivotable drill-pipe robot having gripping arms to load and unload the racking platform and the racking carriage. The racking platform and the racking carriage are moved in synchronism relative to the drill-pipe robot which has a fixed position on the working deck in order to perform drill string dismantling and assembly operations.

7 Claims, 7 Drawing Sheets

DRILLING DERRICK DEVICE

BACKGROUND OF THE INVENTION

The invention relates to a drilling derrick device for handling drill-pipe stands.

Drilling derrick devices of a conventional type of construction for handling drill-pipe stands are provided with two racking platforms for receiving the drill-pipe stands, the racking platforms being rigidly connected to derrick girders at corner regions situated at opposite sides of the drilling derrick and racking surfaces (so-called "setbacks") for the stands are provided beneath the platforms and integrated into the working deck. The particular drill-pipe stands of the drill string are usually introduced into the finger spaces of appropriate rows of fingers of the racking platforms by the crew of the drilling derrick, using block and tackle and lifting cranes, with laborious and time-consuming work and not inconsiderable risk of accident. It is also known to equip a drilling derrick with a drill-pipe robot (pipe handler) which can travel between the drill string and the racking platforms and setbacks and which, for example in order to change the drilling tool, conveys one detached drill-pipe stand at a time to a particular finger space of a row of fingers of a racking platform ready to receive it and introduces and racks the drill-pipe stand by means of its gripping arms and then returns to its initial position to convey a following drill-pipe stand. Because of the long conveying distances along the racking platforms which have to be travelled over by the drill-pipe robot for the dismantling and assembly respectively of a drill string of up to at least five meters in modern drilling derricks, and particularly in the case of relatively great drilling depths, here, too, the operation of assembling or dismantling the drill string is extremely time-consuming and, as a result, also cost intensive. In addition, as a result of the travelling movement of the drill-pipe robot under the load of the drill-pipe stands, vibrations may occur which impair the stability of the derrick.

SUMMARY OF THE INVENTION

It is the object of the present invention to provide an improved drilling derrick device for handling drill-pipe stands which is structurally simple and using which, the drill string can be assembled and dismantled considerably faster. In order to solve this problem, there is provided, according to the invention, a drilling derrick device comprising at least one racking platform or the like having finger space receiving compartments for drill-pipe stands disposed side by side, which can be supported above the working deck of a drilling derrick, at least one racking carriage having a drill-pipe racking surface associated with the racking platform which can be supported on the working deck of the derrick and a pivotably movable drill-pipe robot which can be fixed to the working deck of the derrick, the robot having gripping arms for loading and unloading the racking platform and the associated drill-pipe racking surface with drill-pipe stands, wherein the racking platform and the racking carriage are made movable and can be moved in synchronism with one another relative to the drill-pipe robot.

As a result of the synchronous mobility of racking platform and racking carriage in relation to the fixedly mounted, but pivotable, drill-pipe robot, not only drill string and drilling tools (drill crown and fishing tool, milling head and the like) but also drill collars and so-called "heavy-weights"—in so far as they are present in individual cases—can be installed and/or removed considerably more quickly than with known devices. Checking and replacing a drilling tool can, therefore, be accomplished in a relatively short time so that the drilling derrick is ready for use again for the drilling work to be carried out, after short intervals of time. Thus, the cost-intensive down times of the drilling derrick can be reduced to a considerable extent. During the conveying of the drill-pipe stands, the racking platform and the racking carriage are brought into the particular loading or unloading position in which the drill-pipe robot can continuously place the drill-pipe stands in the finger spaces of the rows of fingers of the racking platform and on the corresponding regions of the racking carriage or extract the drill-pipe stands from these finger spaces by means of a pivotal movement and extension of its gripping arms. Time-consuming conveying distances from the bore hole to the lateral end regions of the working deck are completely eliminated using a device of the invention. After a finger space of a row of fingers has been filled or emptied in the course of the conveying movement of the drill-pipe robot and its gripping arms, the racking platform and the racking carriage can be moved, in a simple manner from the structural and control points of view, into the next receiving or extraction position. The travel distance to be covered is restricted to an extent corresponding to the finger spacing of the racking platform. The rhythmic further positioning of racking platform and racking carriage can be accomplished by conventional drive and control elements. The racking carriage and the racking platform preferably have an electric-motor drive with a control which automatically sets the appropriate next position after, for example, manual actuation of a tripping device. Alternatively, the drive for positioning the racking platform and the racking carriage at a particular racking position necessary may co-operate with stops or the like indexing means. The racking platform and the racking carriage are appropriately guided, in a structurally simple manner, on girders of the drilling derrick and on runway rails located on the working deck respectively. As a result of the elimination of travelling conveying movements of the drill-pipe robot, the conveying of the drill-pipe stands is effected free of oscillation and hence without impairing the stability of the drilling derrick.

Two or three racking platforms, each with an associated racking carriage may be provided at opposite lateral regions of a drilling derrick, that is to say there may be a total of four or six platforms and four or six carriages. The racking carriages laden with drill-pipe stands may be appropriately placed in a region of the working deck remote from the working deck superstructures, the deck being appropriately reinforced so that the racking platforms and racking carriages can be carried in this region and moved from this region in the direction of the working deck superstructures during an unloading operation. After the racking carriages have been unloaded, to enable them to be removed from the working region of the working deck in a simple manner they may be hinged so as to be foldable into a substantially upright inoperative position in order to provide travelling space for a following racking carriage. The present invention offers the further possibility of using racking carriages only in the appropriate number and size which is needed according to the length of a drill string to be assembled or dismantled. Thus, with relatively short drill strings, the working deck can be kept free of unneeded setbacks.

The above and further advantageous features of the invention will become apparent from a consideration of the following detailed description, given by way of example, with reference to drawings of one embodiment of the present invention.

DETAILED DESCRIPTION OF THE SPECIFIC EMBODIMENT

Figure 2:
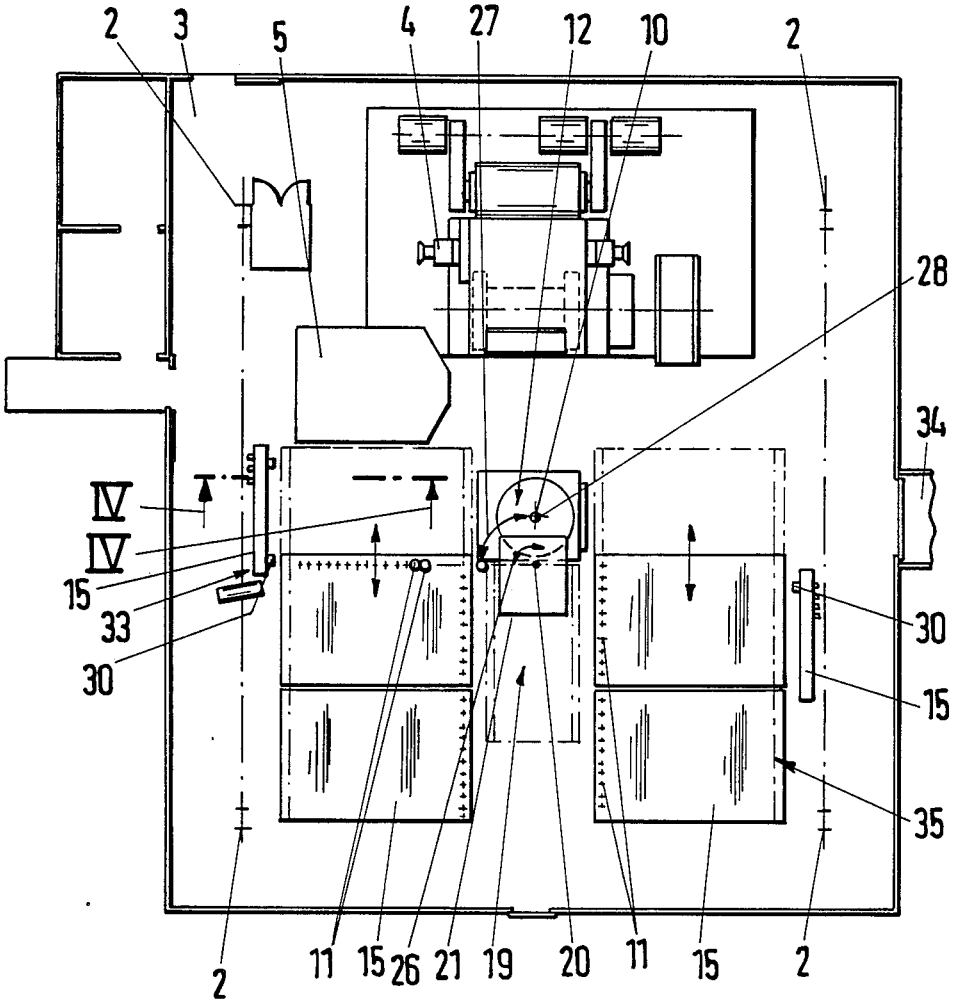
FIG. 2 shows a plan view of the working deck of the drilling derrick with work superstructures mounted thereon.

The drilling derrick designated in general by 1 in the drawing and having drilling-derrick girders 2 as well as a working deck 3, on which a winch 4 and a crane-operator's control position 5 are mounted according to the illustration in FIG. 2, is provided with a block and tackle 7 guided for vertical movement on rails 6 and having a draw hook 8 and an elevator 9. In order to draw the drilling string, generally indicated by the numeral 10, out of the bore hole 12, the elevator 9 engages round the upper end connection 13 of a drill-pipe stand 11 so that, as a result of the corresponding upward lifting movement of the block and tackle 9, the drilling string 10 is pulled out so far that the lower end connection 13 of the drill-pipe stand 11 to be racked is lifted above the surface of the working deck 3.

Figure 1:
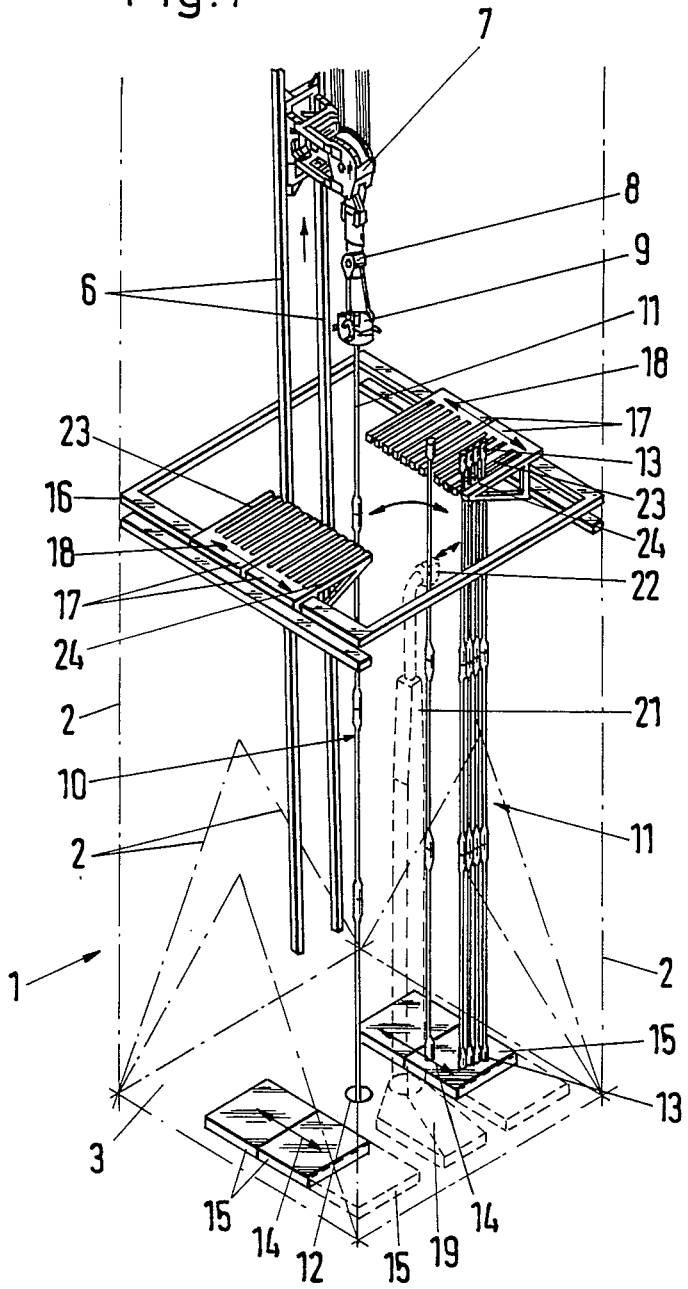
FIG. 1 shows, in a diagrammatic perspective illustration, a drilling derrick device according to the invention.

Two racking carriages 15, which can travel in the direction of the arrows 14 illustrated in FIG. 1 are supported on the working deck 3 in opposite lateral regions of the derrick in each case. Above the working deck, with spacing corresponding substantially to the length of the drill-pipe stands 11 to be racked, runway rails 16 are secured to the drilling derrick girders 2 on which two racking platforms 17, disposed one behind the other, are likewise guided for travelling in the direction of the arrows 18 (FIG. 1) in each case. A racking carriage 15 is associated with each of the racking platforms 17. Each of the racking platforms with its associated racking carriage travels synchronously in relation to a drill-pipe robot (pipehandler) 19 fixedly mounted on the working deck 3. The pipehandler 19 has a tower construction 21 which is pivotable about a vertical axis 20 (FIG. 2) and comprises gripping arms 22 which can be extended and retracted to grip the drill-pipe stand 11 to be conveyed or to be racked on the racking surface (setbacks) of a racking carriage 15 and introduced into spaces between the rows of fingers 23 of the racking platform 17 provided with fingers 24.

When the drilling string 10 has been pulled so far out of the bore hole that the lower end connection 13 of the drill-pipe stand to be racked is above the surface of the working deck 3 and the upper end connection 13 of the drill-pipe stand 11 is above the racking platform 17, the drilling string 10 is first stayed by wedges. The pipehandler 19, the pivotal axis 20 of which is immediately adjacent to the bore hole 12 and the turntable 25 (FIG. 3) of the drilling derrick 1, grips with its gripping arms 22 the drill-pipe stand 11 to be racked, and unscrews it from the drilling string 10 still in the bore hole. After the elevator 9 has been opened, the unscrewed drill-pipe stand is held by the pipe-handler 19 which lifts it from the drilling string 10 and swings it through 90° about its pivotal axis 20 (arrows 26 and 27 in FIG. 2). After this pivotal movement, a drill-pipe stand 11 to be racked is immediately in front of the row of fingers 23 of the racking platform 17 in which the drill-pipe stand is to be placed after extension of the gripping arms 22. After that, the tower construction 21 of the pipehandler 19 pivots back through 90° in order to convey the next drill-pipe stand in a similar sequence of operations. The end faces of the racking platforms 17 and of the racking carriages 15 and the longitudinal axis 28 of the bore hole have substantially the same spacing from the pivotal axis 20 of the drill-pipe robot 19 so that the drill-pipe stand 11 from the drilling string 10 can be placed directly in front of the particular finger space of the row of fingers receiving the drill-pipe stand, without any other travel of the robot 19, simply by the 90° pivotal movement of the tower structure 21 as described. After a finger space of the row of fingers has been filled, the racked drill-pipe stands can be secured in position by means of a locking device not shown in detail.

Figure 6:
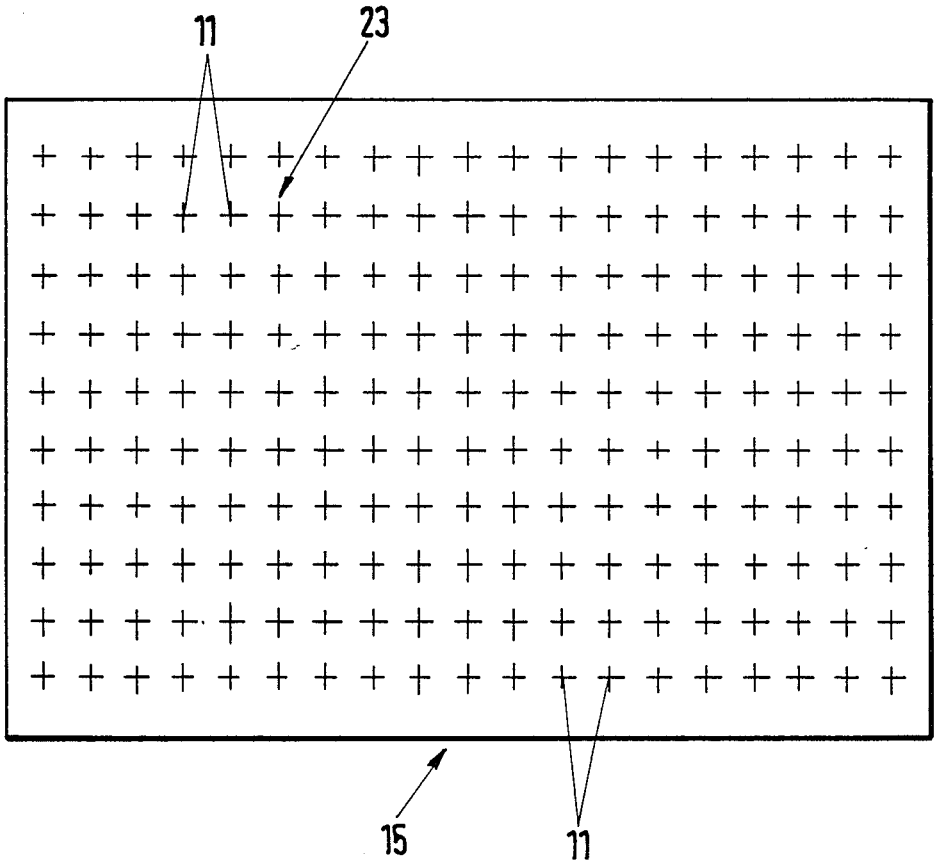
FIG. 6 shows a plan view of a racking carriage on which the racking positions of the drill-pipe stands are illustrated.

As soon as a finger space of a row of fingers 23 has been loaded with drill-pipe stands 11, or unloaded during assembly of a drilling string 10, the particular racking platform 17 and the associated racking carriage 15 are moved synchronously in a direction towards the work deck superstructures 4 and 5 (FIG. 2) mounted on the working deck 3, or in the opposite direction, by an amount corresponding to the spacing of the finger spaces of the racking platform 17. For this purpose, the electric-motor drives 29 and 43 of the racking carriage 15 and racking platform 17 comprise control elements not illustrated in detail which, after actuation of a cycle tripping device, automatically bring racking platform 17 and racking carriage 15 into the next receiving position corresponding to the finger spacing. This travel movement is effected immediately after the loading or unloading of a finger space of a row of fingers 23 so that the pipehandler 19 can handle the next drill-pipe stnad 11 into or in the adjacent finger space row straightaway, without interrupting its operation. When a racking carriage 15 has been completely unloaded (FIG. 6), the racking carriage 15 is brought out of the working region of the working deck 3. For this purpose, hinge members 30 with joint plates 31 are secured to the working deck 3 in the embodiment now being described, on which joint plates 31, connecting flanges 32, formed on the racking carriage 15, can be fixed in position by means of a simple pintle so that an unloaded racking carriage can be swung into an upright inoperative position (reference numeral 33) as shown in FIG. 2. A following racking carriage 15 can now travel into the space on the working deck 3 which has become free as a result.

If a drill-pipe chute 34 is provided at a lateral edge region of the working deck 3 for example, the racking carriage 15 should preferably be displaced, in its upright inoperative position 33, so that after having been moved into its upright inoperative position, it can be brought into a region (reference numeral 35 in FIG. 2) of the working deck in which it does not hamper free access to the drill-pipe chute 34. Rails or other suitable transport guide members are let into the working deck 3 for the displacement of the upright racking carriage 15. The racking carriage 15 can also be moved out of the way by means of rolling pallets or by means of a crane. Instead of the hinge members 30 secured to the working deck 3, the working-deck superstructures 4 and 5 may, for example, be located on the working deck 3 so as to form a receiving compartment, not shown, for one or more racking carriages 15 so that, after the drill-pipe stand 11 have been unloaded, a racking carriage 15 can be pushed like a drawer under the winch 4 or the crane-operator's control platform 5. Depending on the length of the drilling string 10 to be assembled or dismantled, the possibility is also afforded in the drilling derrick device being described of leaving empty racking carriages which are not needed, in their inoperative position, thus enlarging the working space.

Figure 3:
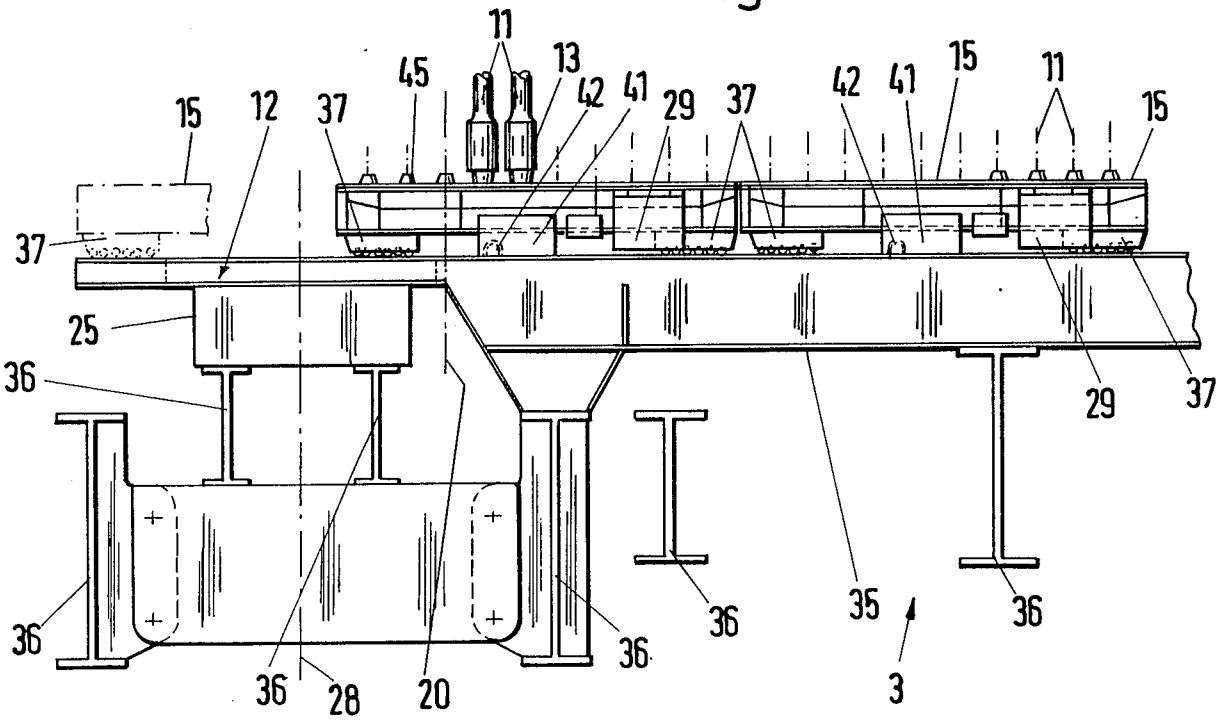
FIG. 3 shows, as a detail, a cross-sectional illustration of the working deck and of the racking carriages without illustrating the pipe-handler.
Figure 4:
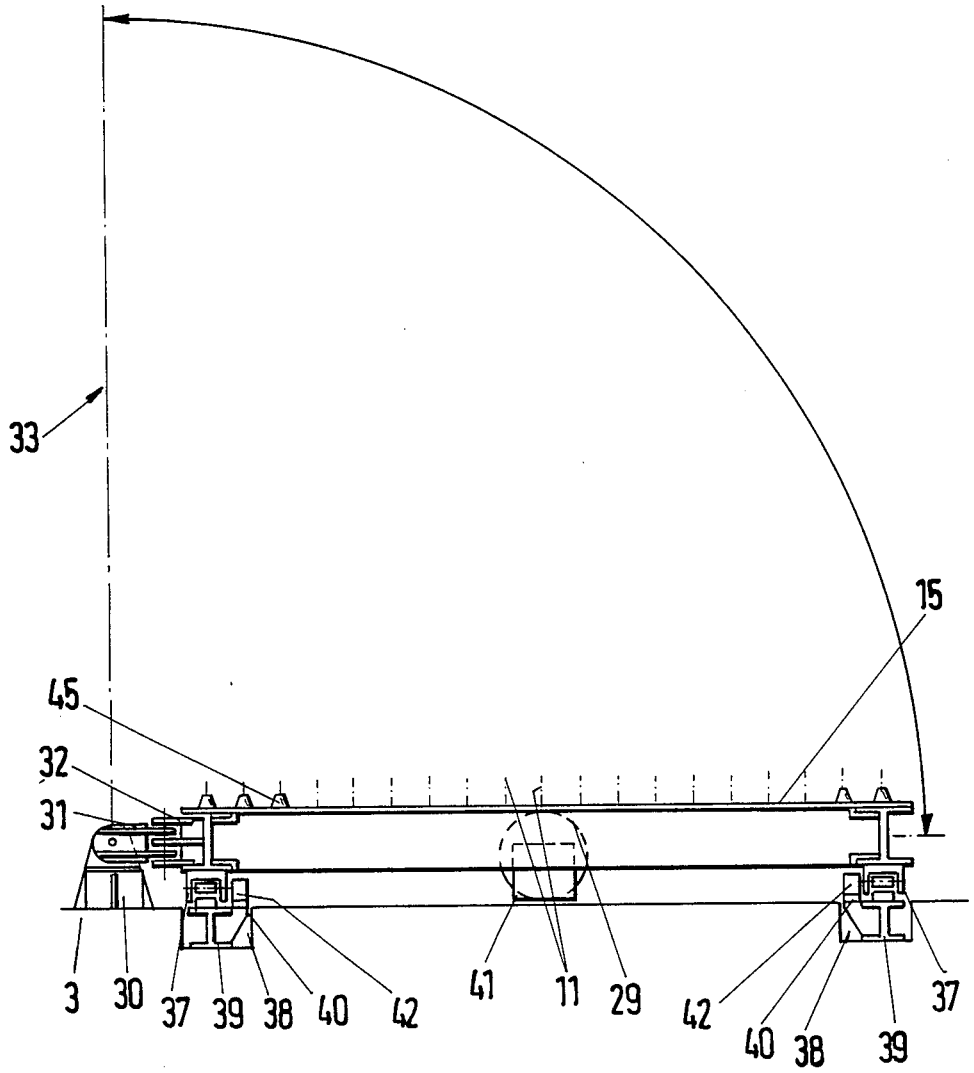
FIG. 4 shows on the section line IV—IV in FIG. 2 a cross-sectional illustration of the racking carriage which is located on the working deck in a hinged manner.
Figure 5:
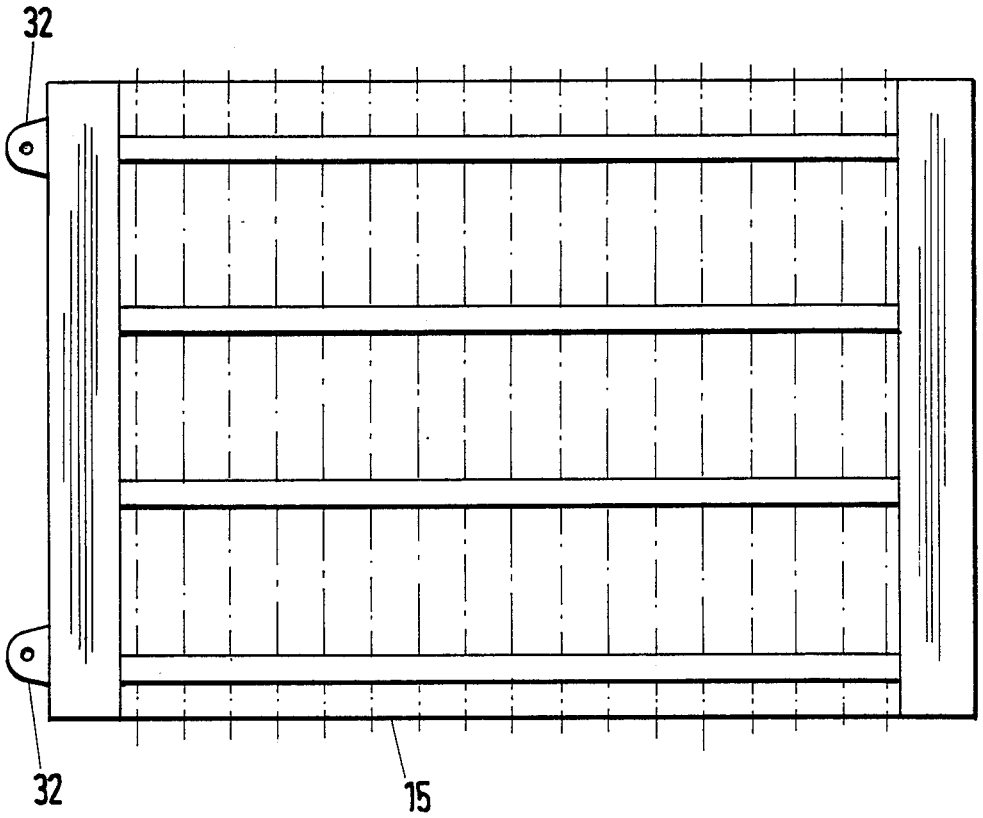
FIG. 5 shows a plan view of a racking carriage with hinge connection flanges.

In FIG. 3 a detail of the working deck 3 with racking carriages 15 guided for movement thereon is illustrated in cross-section, the illustration of the drill-pipe robot 19 being dispensed with to show details with greater clarity. What is shown, however, is the vertical pivotal axis 20 of the drill-pipe robot 19 which is positioned immediately adjacent to the bore hole 12 and the turntable 25. The supporting girders 35 of the working deck 3 are made of appropriately strong dimensions in the racking region of the drill-pipe stands and in the region of the setbacks remote from the working deck superstructures 4 and 5. The supporting girders 35 and the turntable 25 are supported on the H-girders 36. The racking carriages 15 are provided at their top with drill-pipe holders 45 and at their bottom with conventional sets of rollers 37 which are guided on runway rails 39 disposed in recesses 38 in the working deck (FIG. 4). Provided at the top, on both runway rails 39, are racks 40 which co-operate with drive pinions 42 driven by an electric drive 29 via gearing 41 for the displacement of the racking carriages 15. Tilting of the carriage 15 during the travel movement under load is prevented by the drive pinions 42 which are provided at both sides of each racking carriage 15.

In the example being described, the electric motor 29 and the gearing 41 are positioned below the racking surface of the racking carriage 15. Alternatively, the drives may be positioned on the working deck and the racks may be protected from soiling by being positioned below the racking surfaces of the racking carriages 15. In the present case, the electromotor drives 29 each have a current lead with a detachable plug, not illustrated, which is pulled out in order to move each unloaded racking carriage 15 out of the way.

Figure 7:
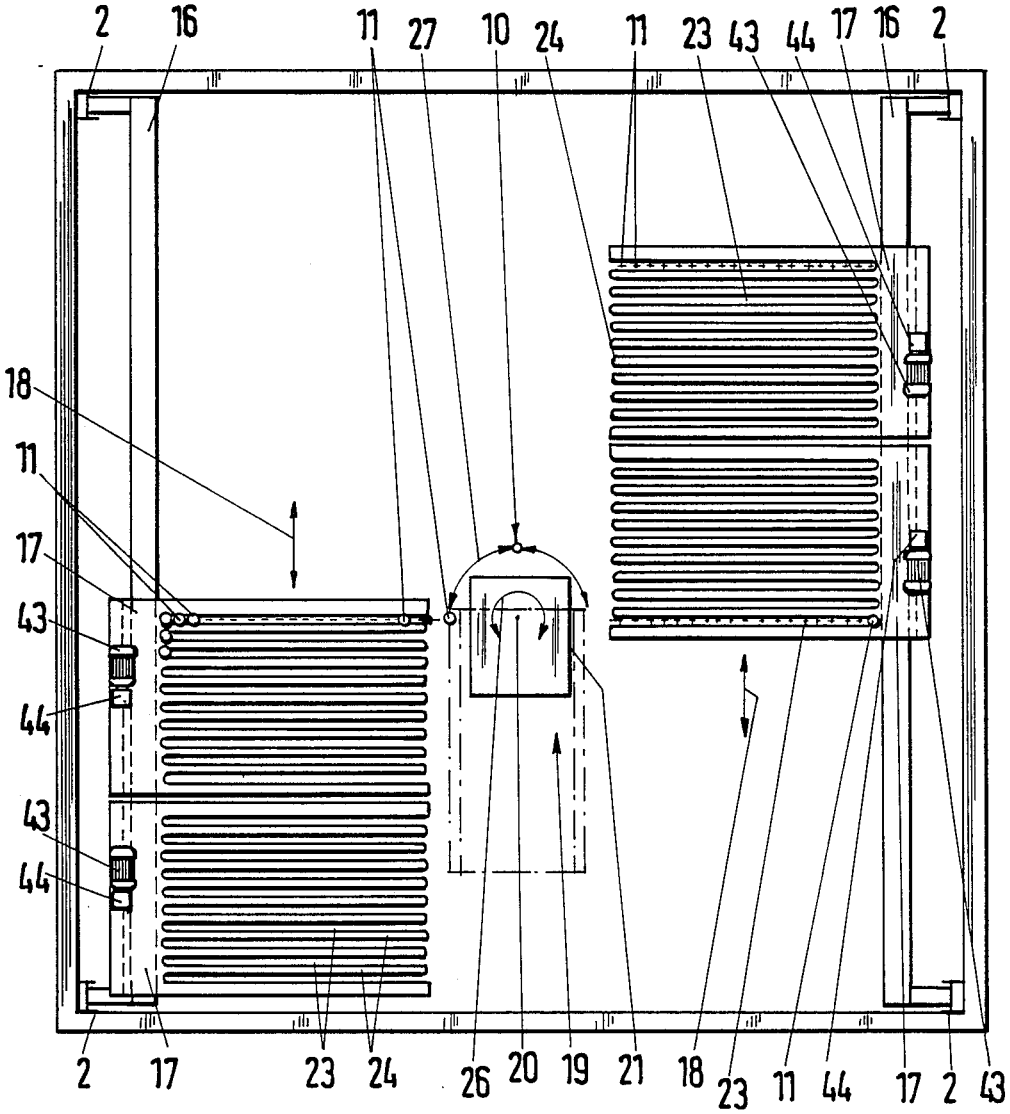
FIG. 7 shows, in diagrammatic plan view, the racking platforms of the drilling derrick device according to the invention which are located on drilling-derrick girders for travelling.

The racking platforms 17 provided at opposite lateral regions of the drilling derrick 1 are illustrated in more detail in FIG. 7. The two racking platforms 17 on the left in the drawing are shown in a working position in which, during dismantling of the drilling string 10, the last finger space of the row of fingers 23 of the adjacent platform 17 is being loaded with drill-pipe stands 11. The two racking platforms 17 and racking carriages 15 have already travelled into their rear end position in the reinforced working-deck region. The racking platform 17 illustrated on the right in FIG. 7 are shown in a working position in which, during assembly of a drilling string 10 and hence unloading of the racking platforms 17, the last drill-pipe stands 11 of the last finger space of row of fingers 23 of the adjacent platforms are being removed. Each racking platform 17 is equipped with a drive 43 and gearing 44 and is driven in a similar manner to the racking carriages 15 through drive pinions and racks not illustrated. The drives 43 and 29 are coupled, with regard to control, for synchronous movement of the respective racking platforms 17 and their associated racking carriages 15. In the example being described, the racking platforms are rectangular in shape and are guided on rectilinear runway rails 16. If it is necessary or advantageous, the racking platforms 17 may also be guided for movement over a circular path concentric with the longitudinal axis 28 of the bore hole and be constructed, for example, in the form of a revolving racking platform.

We claim:

1. A drilling derrick for drilling a bore hole having a bore hole axis using drill pipe, comprising a derrick support structure having a working deck, a racking carriage movably mounted on said working deck, rail means on said support structure above said working deck, a racking platform movably mounted on said rail means and having a plurality of parallel and elongated finger means spaced from one another a first distance to define spaced and elongated parallel receiving channels each of which receive a plurality of sections of said drill pipe, a drill pipe robot means pivotably mounted on said working deck for pivotable movement about a stationary pivotal axis, said robot means having gripping arms for gripping a drill pipe section such that a gripped drill pipe section can be pivoted by said robot means between a first position in which the gripped pipe section overlies said bore hole and a second position in which the gripped pipe section is laterally spaced from said bore hole, and operable means on said racking platform and on said racking carriage for moving said racking platform and racking carriage in synchronism with one another relative to said robot means to a plurality of positions to successively move said racking platform and racking carriage linearly an amount equal to said first distance such that said plurality of elongated receiving channels are thereby successively located at a transfer position such that a plurality of drill pipe sections can be successively transferred to and from said racking platform and racking carriage at said transfer position by said pivotably mounted robot means, said transfer being effected between said robot means and the drill pipe section in the receiving channel located in said transfer position, said fixed pivotal axis of said robot means being spaced from said bore hole axis by a second distance, each of said elongated receiving channels having an open end, each of said elongated finger means having a terminating end juxtaposed to said open end, said terminating ends defining an imaginary terminating line which is tangent to a circle having as its center the fixed pivot axis of said robot means and having a radius substantially equal to said second distance.

2. A drilling derrick according to claim 1, wherein said racking platform and said racking carriage are movable by said operable means along a linear path of travel, said linear path of travel being parallel to a tangent to a circle having a center coincident with said fixed pivotal axis of said robot means.

3. A drilling derrick according to claim 1, wherein said racking platform comprises pivotal means pivotably mounting said racking platform on said derrick structure between an operable position and an inoperable position, said racking platform when in said operable position being generally horizontally disposed and being operable to effect said transfer of said drill pipe sections, said racking platform when in said inoperable position being generally vertically disposed.

4. A drilling derrick according to claim 1, wherein there is at least one racking platform and at least one racking carriage on one side of said derrick structure and at least one other racking platform and at least one other racking carriage on another side of said derrick structure, said at least one racking platform and said at least one racking carriage constituting a first pair and said at least one other racking platform and said at least one other racking carriage constituting a second pair, said one pair being spaced from said second pair, said first and second pairs being on opposite sides of said fixed pivotal axis of said robot means.

5. A drilling derrick according to claim 4, wherein said operable means is operable to move said first and second pair along parallel paths of travel.

6. A drilling derrick according to claim 4, wherein said operable means comprises first electric motor means for moving said racking platform and second electric motor means for moving said racking carriage means.

7. A drilling derrick according to claim 1, wherein said racking carriage comprises a plurality of drill pipe holders for receiving and holding said drill pipe sections.

* * * * *